United States Patent [19]

dePolo

[11] 4,084,600

[45] Apr. 18, 1978

[54] UMBRELLA

[76] Inventor: Harry Rudolph dePolo, 480 Park Ave., New York, N.Y. 10022

[21] Appl. No.: 796,439

[22] Filed: May 12, 1977

[51] Int. Cl.[2] ..... A45B 11/00; A45B 15/00; A45B 19/00

[52] U.S. Cl. ..... 135/20 R; 135/34

[58] Field of Search ..... 135/20 R, 19.5, 34

[56] References Cited

FOREIGN PATENT DOCUMENTS 1,429,394 1/1966 France ..... 135/19.5

*Primary Examiner*—Werner H. Schroeder
*Assistant Examiner*—Conrad L. Berman
*Attorney, Agent, or Firm*—Robert E. Burns; Emmanuel J. Lobato; Bruce L. Adams

[57] ABSTRACT

The inner ends of cover-supporting ribs of an umbrella are pivotally connected to a rib carrier which is longitudinally slidable in a hollow shaft by means of a handle extending out through a longitudinal slot in the shaft. The rib carrier is slidable by means of the handle between a closed position in which the rib carrier is near the lower end of the shaft and the rib members together with the cover are in the shaft and an open position in which the rib carrier is at the upper end of the shaft and the rib members radiate out from the rib carrier so as to support the cover. Locking means provided on the rib carrier engage inner ends of the ribs so as to hold them approximately perpendicular to the shaft when in open position. The rib carrier is retained in open and closed positions by a bullet-type spring latch. The cover is provided with pockets to receive outer ends of the ribs and is preferably formed of two-way stretch material.

10 Claims, 8 Drawing Figures

FIG. 2
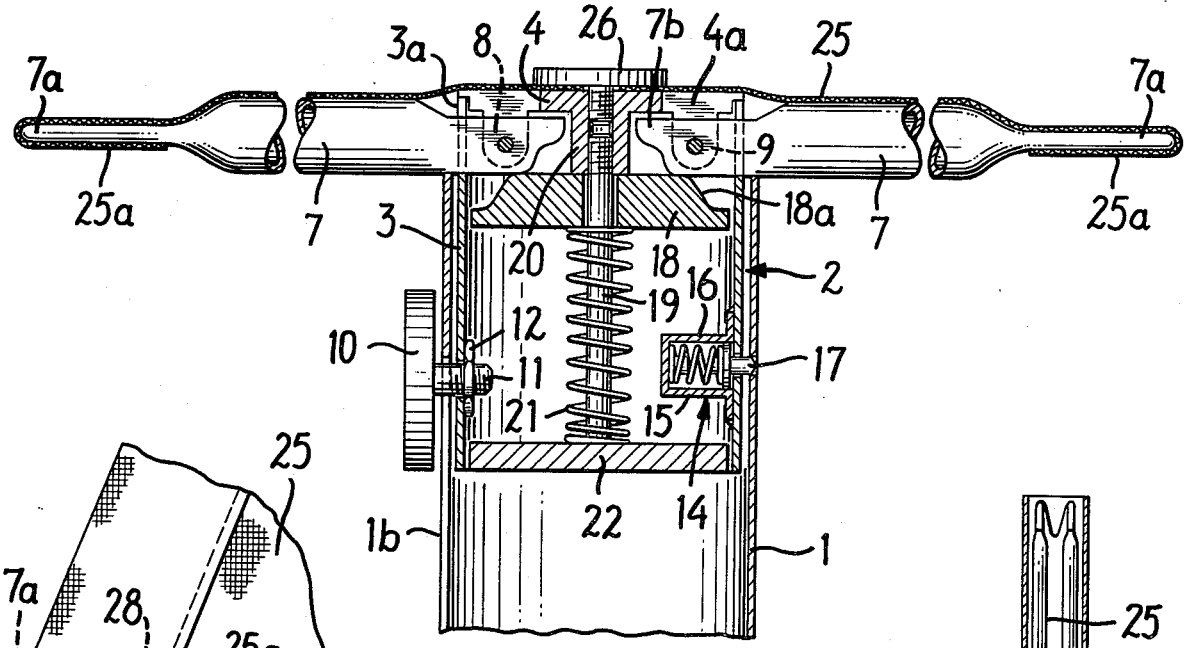
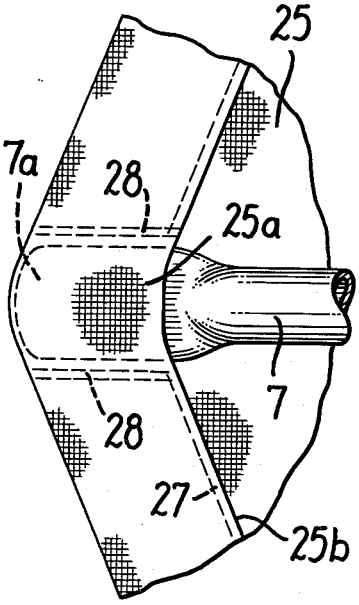
FIG. 7
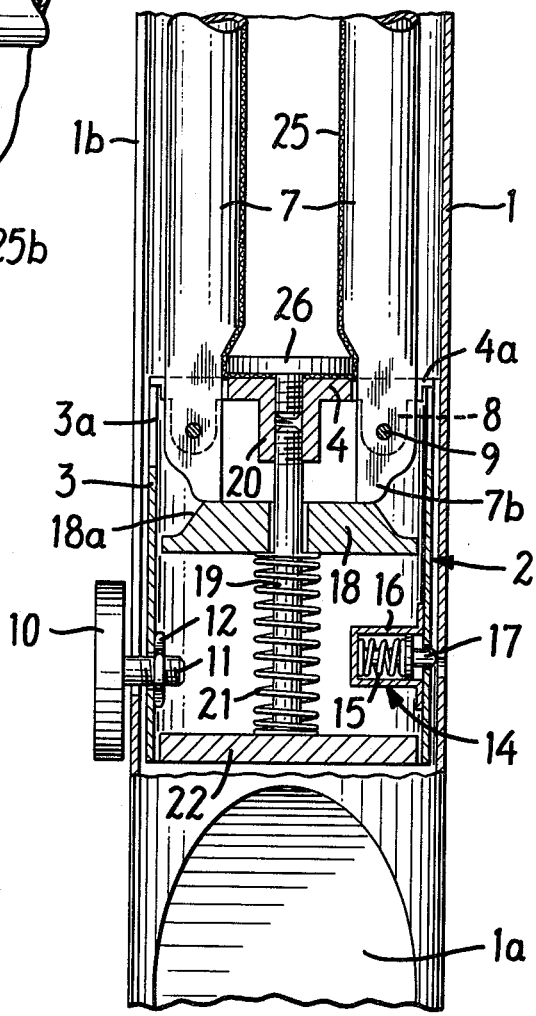
FIG. 3
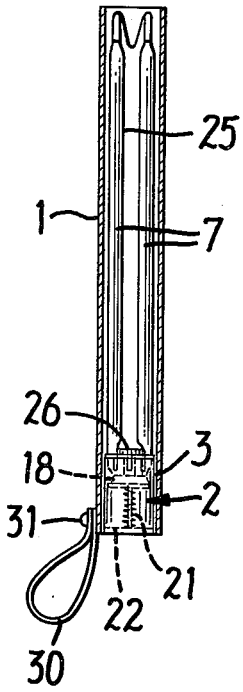
FIG. 8

UMBRELLA

FIELD OF INVENTION

The present invention relates to umbrellas and particularly to umbrellas which are self-contained so that no case or cover is required. The term "umbrella" is herein used in a broad sense to include parasols, sunshades, etc.

BACKGROUND OF THE INVENTION

In a conventional umbrella, the upper ends of ribs are pivotally connected to the upper end of a shaft and the outer ends of stays or struts are pivotally connected to the ribs intermediate their length while the inner ends are pivotally connected to a sleeve which is slidable on the shaft between a closed position in which the ribs and stays lie along side the shaft and an open position in which the stays support the ribs in extended position. The ribs are usually flexible and the cover is fashioned so that the ribs are bowed when in open position. When the umbrella is in closed position the cover lies in loose folds around the shaft and ribs. In order to make the umbrella look somewhat neater when closed, a small strap is attached to the cover near its periphery so that the folds of the cover can be wrapped around the shaft and ribs and secured by the strap. In some instances there is provided an elongated pocket-like sheath of fabric, leather or plastic into which the closed umbrella can be inserted to provide a neater appearance.

It has also been proposed to connect the inner ends of the ribs of an umbrella pivotally to the upper end of a rod which is longitudinally movable in a tube. The inner ends of the stays are pivotally connected to a slide which is longitudinally slidable on the rod and urged downwardly by a spring. The rod is movable longitudinally in the tube by means of an external sleeve which is connected to the rod by a bridge extending through a slot in the tube. When the rod is moved upwardly so that it projects above the tube, the stays support the ribs in extended position much as in a conventional umbrella. When the rod is moved downwardly to the lower end of the tube the stays, ribs and cover are retracted into the tube. While of neater appearance in closed position than a conventional umbrella, the construction is somewhat complex so that it is more expensive to construct and less dependable in its operation. Moreover, in open position it suffers from the same defect as a conventional umbrella in that it can be turned inside-out by the wind.

SUMMARY OF THE INVENTION

It is an object of the present invention to provide an umbrella which avoids the disadvantages of the prior art. In accordance with the invention, there is provided an umbrella comprising an elongate tubular shaft having upper and lower ends and a longitudinally extending slot. A rib carrier is longitudinally movable in the shaft by means of a handle which extends out through the slot. The upper end portion of the rib carrier is slotted to receive and guide the inner end portions of ribs which are pivotally connected to the carrier. By means of the externally projecting handle, the rib carrier is movable longitudinally in the shaft between a closed position in which the rib carrier is near the lower end of the shaft and the rib members are in the shaft and an open condition in which the rib carrier is at the upper end of the shaft and the rib members radiate from the shaft. Latch means is provided for releasably securing the rib carrier in its open and closed positions. The rib carrier is provided with locking means for retaining the ribs approximately normal to the shaft when in open position. A flexible fabric cover which is preferably formed of two-way stretch fabric is secured at its center to the rib carrier and at its periphery to the outer ends of the rib members. The cover overlies and is supported by the rib members when in open position and is drawn down into the shaft with the rib members when the rib carrier is moved to closed position. There is thus provided, in accordance with the present invention, an umbrella which is of simple and sturdy construction and highly attractive in appearance.

BRIEF DESCRIPTION OF DRAWINGS

The nature, objects and advantages of the invention will be more fully understood from the following description of preferred embodiments shown by way of example in the accompanying drawings in which:

FIG. 2 is an enlarged sectional view of an upper portion of the umbrella shown in open position;

FIG. 3 is a partial sectional view showing the ribs and carrier in almost closed position;

FIG. 7 is a fragmentary bottom plan view showing the outer end portion of a rib and adjacent portion of the cover; and FIG. 8 is a small scale longitudinal section of the umbrella in closed position showing a modification.

DESCRIPTION OF PREFERRED EMBODIMENTS

Figure 1:
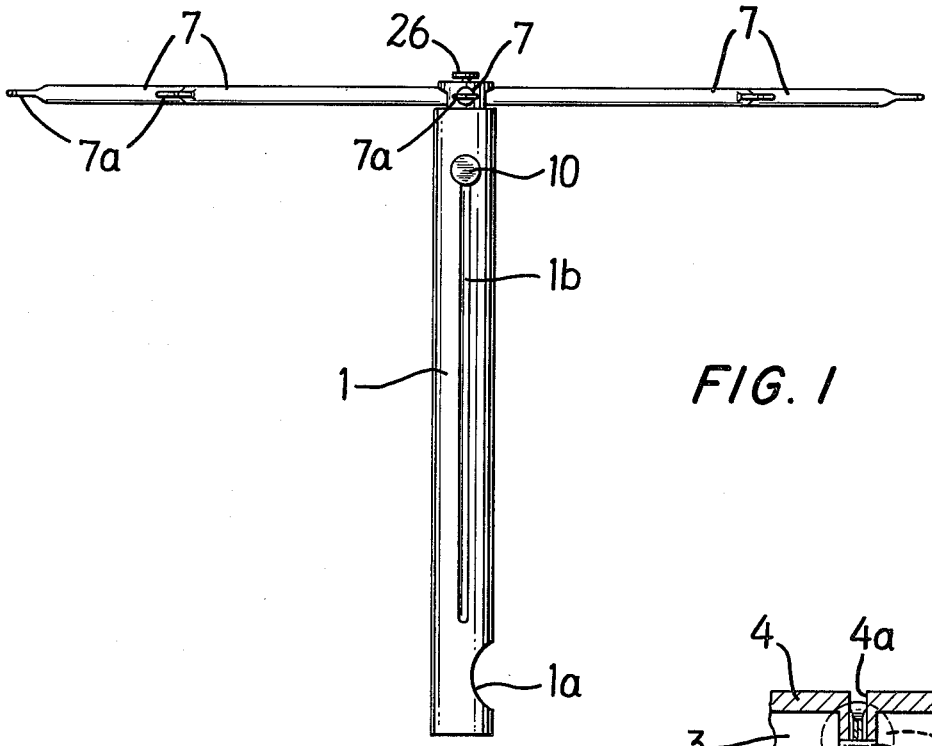
FIG. 1 is a side elevation of the umbrella in open position but with the cover removed for clarity of illustration.

As illustrated, by way of example, in the drawings the umbrella comprises a tubular shaft 1 which serves not only as a handle for the umbrella but also as an enclosure when the umbrella is in closed position. The shaft 1 is, for example, about 1½ inches to 2 inches in diameter and about 18 inches or 23 inches long. It can, if desired, be made of lightweight metal tubing, for example, aluminum or magnesium, but is preferably plastic tubing which can be provided in many attractive colors. An indentation or cut-out **1*a* is provided near the bottom of the shaft 1 to serve as a convenient hand grip. The shaft 1 is also provided with a longitudinally extending slot 1*b*** which terminates a short distance from the upper and lower ends of the shaft.

Figure 6:
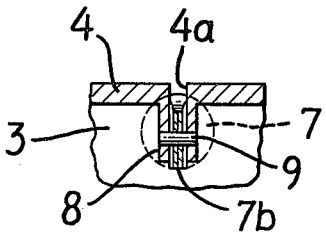
FIG. 6 is a fragmentary sectional view taken approximately on the line 6—6 in FIG. 4.
Figure 4:
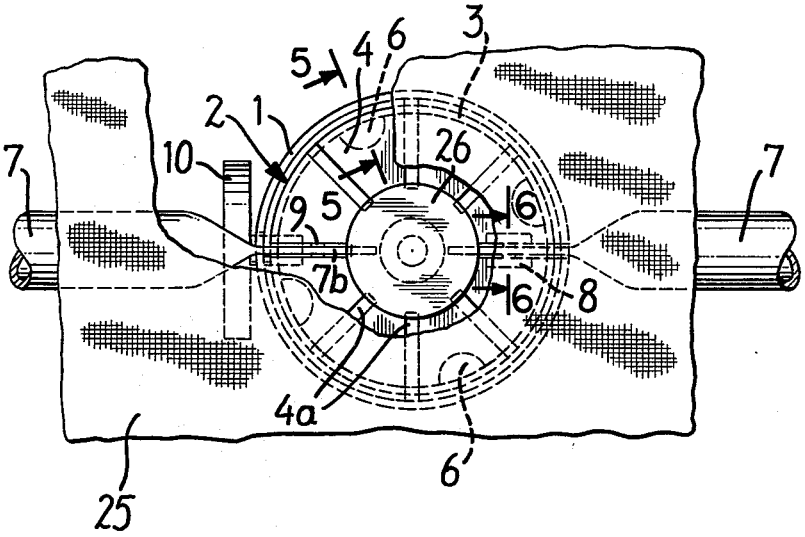
FIG. 4 is a partial top plan view.
Figure 5:
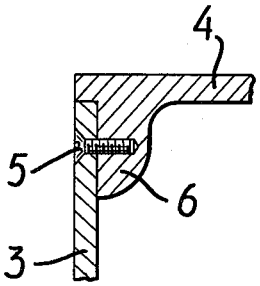
FIG. 5 is an enlarged fragmentary sectional view taken approximately on the line 5—5 in FIG. 4.

Inside the tubular shaft 1 there is a rib carrier 2 which is shown as comprising a tubular sleeve 3 to the upper end of which is affixed a cap 4. The cap 4 is removably affixed to the upper end of the sleeve 3, for example, by means of screws 5 (FIG. 5) which extend through holes in the wall of the sleeve 3 and screw into downwardly extending bosses 6 on the lower side of the cap 4. The cap 4 is provided with radial slots **4*a* which are aligned with axial slots 3*a* in the upper end portion of the sleeve 3 to receive the inner ends of ribs 7. Eight such ribs are shown in the drawing although the number can be varied as desired. The ribs 7 are preferably tubular, for example of light metal or plastic material and have rounded outer ends 7*a*. Inner end portions 7*b* of the ribs 7 are flattened so as to extend through the slots 3*a*** and 4*a* of the rib carrier and be received between spaced tabs 8 (FIG. 6) which extend down from the cap 4. A pin 9 extending through aligned holes in the tabs 8 and the flattened inner portion 7*b* of the rib 7 pivotally connects each of the ribs 7 to the rib carrier 2. In their pivotal movement between the position shown in FIG. 2, and the position shown in FIG. 3, the ribs 7 are guided by the parallel tabs 8 and by the aligned slots 3*a* and 4*a* in the sleeve 3 and cap 4.

The sleeve 3 has an outside diameter slightly smaller than the inside diameter of the tubular shaft 1 so as to be slidable longitudinally in the shaft by means of a knob 10 which is connected with the sleeve 1 by a threaded stud 11 which extends through the longitudinal slot 1*b* in the tubular shaft and is screwed into a nut 12 affixed to the inner wall of the sleeve 3 as shown in FIGS. 2 and 3. By means of the knob 10, the rib carrier 2 is movable longitudinally of the tubular shaft 1 between an open position in which the rib carrier is at the upper end of the tubular shaft 1 and the ribs 7 radiate from the rib carrier and a closed position in which the rib carrier 2 is near the lower end of the tubular shaft 1 and the ribs 7 are inside the tubular shaft 1, as illustrated in FIG. 3 where the rib carrier is shown just slightly above the closed position. Latch means is provided for releasably retaining the rib carrier 2 in open and closed positions. Such latch means is shown by way of example in the drawings as comprising a bullet-type latch 14 in which a compression spring 15 in a barrel 16 urges a latch member 17 into aligned holes in the sleeve 3 and tubular shaft 1 when the rib carrier is in open position or in closed position. The latch member 17 may be in the form of a ball but is shown as a small plunger with a rounded nose.

The rib carrier 2 is further provided with means for holding the ribs 7 approximately perpendicular to the tubular shaft 1 when the umbrella is in open position as illustrated in FIG. 2. Such means is illustrated by way of example in FIG. 2 as comprising a circular locking plate 18 which is slidable on a rod 19, the end of which is threaded and screwed into a tapped central boss 20 extending down from the cap 4 of the rib carrier. A compression spring 21 surrounds the rod 19 and acts between the pressure plate 18 and a disc 22 fixed to the lower end of the rod 19 so as to urge the pressure plate upwardly. The upper surface of the pressure plate 18 engages inner ends of the ribs 7 inwardly of the pivots 9 so as to restrain the ribs from swinging upwardly. Downward movement of the ribs is prevented by engagement with the bottoms of the slots 3*a* and with the upper edge of the tubular shaft 1. Moreover, if the ribs were to swing downwardly beyond the position shown in FIG. 2 inner ends of the ribs would engage the cap 4 inwardly of the inner ends of slots 4*a*. Thus, when the rib carrier 2 is in open position, the ribs 7 are held in a position approximately perpendicular to the shaft 1. It will be noted that this is accomplished without the use of stays such as are employed in a conventional umbrella. The present invention thus provides a simpler and at the same time more rugged construction. Instead of the ribs 7 being flexible so as to bend as in a conventional umbrella they are substantially rigid. The tubular form of the ribs provides sufficient strength and stiffness with low weight.

The pressure with which the locking plate 18 is pressed against the inner end portions of the ribs 7 is determined by the spring constant of the spring 21 and can be adjusted by rotation of the disc 22 and hence the rod 19 so as to screw the threaded upper end of the rod a greater or lesser distance into the tapped central boss 20 of the cap 4. While the disc 22 is shown as having a diameter almost equal to the inner diameter of the sleeve 3 so as to provide lateral support for the lower end of the rod 19 it can be made smaller if desired and may have a hexagonal or other noncircular shape to facilitate its rotation.

When the rib carrier 2 is moved downwardly by means of the knob 10 from the open position shown in FIG. 2 engagement of the upper end edge of the tubular shaft 1 with the ribs 7 outwardly of the pivots 9 causes the ribs 7 to swing upwardly about their pivots. The inner end edges of the flattened inner portions 7*b* of the ribs are contoured so that as the ribs 7 swing upwardly the contoured edges cam the locking plate 18 downwardly against the bias of the spring 21. As downward movement of the rib carrier 2 continues, the ribs 7 swing upwardly to a position approximately parallel to one another, as shown in FIG. 3, and moved downwardly into the shaft 1 so that in closed position the ribs are fully retracted into the shaft which thereby provides an attractive casing for the closed umbrella. While the locking plate 18 is shown as having a contoured peripheral edge 18*a* it will be seen from FIGS. 2 and 3 that this does not engage the ribs either in open position or in closed position and its shape is hence arbitrary. While the locking plate 18 is shown as having a diameter almost as great as the inner diameter of the sleeve 3, it can, if desired, be made somewhat smaller since adequate guidance for the locking plate 18 is provided by the rod 19. However, the locking plate 18 must be large enough to engage inner ends of the ribs 7 inwardly of the pivots 9, as illustrated in FIG. 2, so as to hold the ribs perpendicular to the shaft 1 when the rib carrier is in open position.

The umbrella further comprises a fabric cover 25. At its center the cover is secured to the rib carrier 2 by a large headed screw 26 which extends through a central hole in the cover 25 and screws into the tapped boss 20 of the cap 4. At its periphery the cover 25 is provided with pockets 25*a* which receive the outer ends of the ribs 7. As illustrated by way of example in FIGS. 2 and 7, the outer edge of the cover 25 is folded under so as to provide a peripheral hem 25*b* which is secured by stitching 27. Further stitching 28 forms the pockets 25*a* in which the outer ends of the ribs 7 are received. The outer ends of the ribs 7 are preferably flattened so as to lie in an approximately horizontal plane when the umbrella is open and are rounded as shown so that they do not cut or pierce the fabric. The flattening of the end portions of the ribs avoid catching of the hemmed portion of the cover on the upper edge of the tubular shaft 1 when the umbrella is being closed. The cover is preferably made of two-way stretchable fabric, for example, tricot fabric knit of spandex yarn and is suitably waterproof, for example, by a Zepel treatment. By reason of its two-way stretch, the fabric of the cover contracts when the umbrella is closed and is hence less bulky when the ribs together with the cover are drawn into the shaft 1.

Since the cover is attached only by the removable screw 26 and by the ends of the ribs slipping into the pockets provided at the periphery of the cover, it can be easily removed and replaced. Thus a soiled cover can be removed for washing and a damaged cover can be removed for repair or replacement. Moreover, the user can have several covers of different color or pattern which can be used interchangeably.

The umbrella construction in accordance with the present invention is advantageous in that it can be made almost entirely of plastic. Thus the shaft 1 and sleeve 3 can be formed of plastic tubing. The shaft 1 is illustrated as having a diameter of approximately 1½ inches to 2 inches while the sleeve 3 is sufficiently smaller to be slidable inside the shaft. The ribs 7 are also conveniently formed of plastic tubing which may have a diameter of for example ¼ inch to ½ inch. The cap 4 and pressure plate 18 are suitably molded of plastic material. Likewise, the knob 10 with its stud 11 and the disc 22 with its rod 19 can be molded of plastic. In the embodiment illustrated in FIG. 1, the cut-out 1*a* not only provides a convenient hand grip but also makes it possible to hang the umbrella in inverted position from a pin or other support.

A modification is illustrated in FIG. 8 in which the same parts are designated by the same reference numerals as in FIGS. 1 to 7. The embodiment of FIG. 8 differs from that of FIGS. 1 to 7 in that the tubular casing 1 is shorter, having a length only slightly greater than that of the ribs 7. It will be seen that the rib carrier 2 in closed position is at the lower end of the shaft 1. The cut-out 1*a* shown in FIG. 1 is eliminated and instead there is provided a carrying strap 30 secured to the tubular casing 1 by a stud 31. Otherwise the construction is as described with reference to FIGS. 1 to 7.

It will thus be seen that the umbrella of the present invention is of attractive appearance in both open and closed condition. It is of simple and rugged construction and can be manufactured economically. Moreover, it is more durable than conventional umbrellas and in particular is resistant to wind damage. The usual stays of conventional umbrellas are eliminated and the ribs are stronger so that they cannot be easily bent or broken. Moreover, if a rib should become damaged, it can be easily replaced by the user, thus avoiding expensive repairs. As described above, the cover is easily replaceable and interchangeable. Still other advantages will be apparent from the foregoing description.

While preferred embodiments of the invention have been illustrated in the drawings and are herein particularly described, it will be understood that many variations and modifications may be made and that hence the invention is in no way limited to the illustrated embodiments.

What is claimed is:

1. An umbrella comprising an elongate tubular shaft having upper and lower ends and having a longitudinally extending slot between said ends, rib carrier means longitudinally movable in said shaft, a plurality of elongate rib members having inner and outer ends, means pivotally connecting said rib members near their inner ends to said rib carrier means, means fixed to said rib carrier means and projecting out through said slot in said shaft for moving said rib carrier means longitudinally in said shaft between a closed position in which said rib carrier means is near the lower end of said shaft and said rib members are in said shaft and an open condition in which said rib carrier means is at the upper end of said shaft and said rib members radiate from said rib carrier means, latch means for releasably securing said rib carrier means in said open and closed positions, locking means on said rib carrier means for retaining said rib members approximately normal to said shaft when in open position, a flexible fabric cover secured at its center to said rib carrier means and at its periphery to outer ends of said rib members, said cover overlying and being supported by said rib members when in open position and being drawn down into said shaft with said rib members when said rib carrier means is moved to closed position.

2. An umbrella according to claim 1, in which said rib carrier means comprises a cylindrical sleeve longitudinally slidable in said shaft and a cap member fixed on the upper end of said sleeve.

3. An umbrella according to claim 1, in which said rib members are tubular with inner end portions flattened for pivotal connection with said rib carrier means.

4. An umbrella according to claim 1, in which said cover is provided at its periphery with pockets in which outer ends of said ribs are received.

5. An umbrella according to claim 1, in which said cover is of two-way stretchable fabric.

6. An umbrella according to claim 2, in which said locking means comprises a stem member extending downwardly from said cap member of said rib carrier means, a locking member slidable on said stem member and engageable with inner ends of said rib members inwardly of their pivotal connection to said rib carrier means and to spring means biasing said locking member toward the inner ends of said rib members.

7. An umbrella according to claim 2, comprising means for removably affixing said cap member to said sleeve for convenient assembly and disassembly.

8. An umbrella according to claim 2, in which said shaft and sleeve have openings which register with one another when said rib carrier means is in open position and closed position, and in which said latch means comprises a spring pressed latch member engageable in said openings when registered.

9. An umbrella according to claim 2, in which an upper portion of said sleeve has longitudinal slots to receive inner end portions of said rib members.

10. An umbrella according to claim 9, in which said cap member has spaced downwardly extending portions between which inner end portions of said rib members are received, and in which said pivotal connecting means comprises pivot pins extending between said downwardly extending portions and passing through holes in inner end portions of said rib members.

* * * * *